US009155447B2

(12) United States Patent
Baldwin et al.

(10) Patent No.: US 9,155,447 B2
(45) Date of Patent: Oct. 13, 2015

(54) DISH RACK WITH INTEGRAL HYDRAULIC CIRCUIT

(71) Applicant: Whirlpool Corporation, Benton Harbor, MI (US)

(72) Inventors: Mark W. Baldwin, Saint Joseph, MI (US); Barry E. Tuller, Stevensville, MI (US); Ameresh B. Viswanathan, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 45 days.

(21) Appl. No.: 14/030,130

(22) Filed: Sep. 18, 2013

(65) Prior Publication Data

US 2014/0130834 A1 May 15, 2014

Related U.S. Application Data

(60) Provisional application No. 61/725,657, filed on Nov. 13, 2012.

(51) Int. Cl.
*A47L 15/50* (2006.01)

(52) U.S. Cl.
CPC ..... *A47L 15/508* (2013.01)

(58) Field of Classification Search
CPC . A47L 2501/20; A47L 2501/03; A47L 15/50; A47L 15/4282; A47L 15/508; A47L 15/501; A47L 15/0084; A47L 15/0086; A47L 15/0089
USPC ..... 134/25, 198; 211/41.8
See application file for complete search history.

(56) References Cited

U.S. PATENT DOCUMENTS

| | | | | |
|---|---|---|---|---|
| 5,605,236 | A | 2/1997 | Welch | |
| 5,730,301 | A | 3/1998 | Welch et al. | |
| 5,787,911 | A | 8/1998 | Jacobus et al. | |
| 7,331,356 | B2 | 2/2008 | VanderRoest et al. | |
| 7,475,696 | B2 | 1/2009 | Vanderroest et al. | |
| 7,887,642 | B2 | 2/2011 | Jerg et al. | |
| 2002/0185166 | A1 * | 12/2002 | Rosenbauer et al. | 134/200 |
| 2004/0255982 | A1 | 12/2004 | VanderRoest et al. | |
| 2005/0133070 | A1 | 6/2005 | Vanderroest et al. | |
| 2006/0144424 | A1 | 7/2006 | Marchitto et al. | |
| 2007/0235063 | A1 * | 10/2007 | Lee et al. | 134/25.2 |
| 2008/0210274 | A1 | 9/2008 | VanderRoest et al. | |
| 2010/0154846 | A1 | 6/2010 | Vanderroest et al. | |
| 2011/0011430 | A1 | 1/2011 | Barwig et al. | |
| 2011/0030742 | A1 | 2/2011 | Dalsing et al. | |
| 2011/0197937 | A1 | 8/2011 | Vanderroest et al. | |

FOREIGN PATENT DOCUMENTS

| | | | |
|---|---|---|---|
| CN | 2836712 | Y | 11/2006 |
| EP | 1306046 | A1 | 5/2003 |
| EP | 1477101 | A2 | 11/2004 |
| EP | 1488730 | A1 | 12/2004 |
| ES | 2321711 | T3 | 6/2009 |
| GB | 2349330 | A | 11/2000 |

(Continued)

*Primary Examiner* — Michael Barr
*Assistant Examiner* — Rita Adhlakha

(57) ABSTRACT

A dish rack for use in a dishwasher is provided. The dish rack includes a front wall, a pair of spaced apart and opposite side walls, and a back wall interconnected so as to bound a space. A hydraulic circuit is disposed within the walls of the dish rack and a spray nozzle is mounted on the wall.

19 Claims, 10 Drawing Sheets

(56) References Cited

FOREIGN PATENT DOCUMENTS

| | | | |
|---|---|---|---|
| JP | 2001224547 | A | 8/2001 |
| JP | 2005511230 | A | 4/2005 |
| JP | 2006136614 | A | 6/2006 |
| JP | 2009160282 | A | 7/2009 |
| WO | 2008061883 | A1 | 5/2008 |
| WO | 2011019740 | A2 | 2/2011 |
| WO | 2012033351 | A2 | 3/2012 |

* cited by examiner

DISH RACK WITH INTEGRAL HYDRAULIC CIRCUIT

CROSS-REFERENCE TO RELATED APPLICATIONS

The present application claims the benefit of U.S. Provisional Patent Application No. 61/725,657, filed Nov. 13, 2012, which is incorporated by reference herein in its entirety.

BACKGROUND OF THE INVENTION

1. Field of the Invention

The present invention pertains to the art of dishwashers and, more particularly, to a dish rack configured to distribute water to a predetermined wash zone within the tub.

2. Description of the Related Art

A front loading dishwasher typically includes a tub having an open front. The tub defines a washing chamber into which items, such as kitchenware, glassware and the like, are placed to undergo a washing operation. The dishwasher is generally provided with a door, pivotally mounted to the tub, which closes the open front. The dishwasher generally includes upper and lower extensible dish racks for supporting items during the washing operation. Typically, the upper and lower dish racks are formed primarily of a durable, rigid and water resistant material such as chemically treated steel.

A spraying system is operable to spray liquid into the tub. The spraying system may include an upper sprayer, a lower sprayer, and a spray manifold. The upper sprayer may be located below the upper rack, and includes spray apertures configured to introduce liquid upwardly within the tub. The lower sprayer may be located on the bottom floor of the tub, and includes spray apertures configured to introduce liquid upwardly within the tub. A top sprayer located above the upper rack may also be used to spray downward. The upper and lower sprayer may be a rotatable spray arm or may be fixed. In instances where the sprayer is rotatable, the sprayers may have a difficult time introducing water into the corners of the tub.

It may also be desirable to introduce water from the side, back or front walls of the tub. In such instances the spraying system includes hydraulic conduits formed along a respective side, back or front wall of the tub. However, incorporating hydraulic conduits into the side, back or front walls of the tub decreases the volume of the washing chamber. It should be appreciated by those skilled in the art, that the greater the volume of the washing chamber, the more utensils may be introduced in the dishwasher.

Based on the above, there still exists a need in the art for a dishwasher operable to introduce water to the corners of the tub. Further, it remains desirable to add additional spray zones without decreasing the volume of the washing chamber. Further, it remains desirable to have a dishwasher wherein spray nozzles may be configured to direct water to a specific wash zone.

SUMMARY OF THE INVENTION AND ADVANTAGES

The present invention is generally directed to a dishwasher including a tub that defines a washing chamber and an extensible dish rack for supporting items to be washed in the washing chamber. In accordance with the invention, the dish rack may be formed of a combination of molded polymer and wire. The dish rack includes a hydraulic circuit having a hydraulic circuit intake operable to dock with a tub outtake.

The dish rack may include spray nozzles configured to be in fluid communication with the hydraulic circuit. The spray nozzles are selectively disposed on the dish rack so as to introduce water into a predetermined wash zone of the washing chamber. Accordingly, water may be introduced from the sides, front, or back of the washing chamber. Further, the volume of the washing chamber is not compromised by the addition of hydraulic passages within the side walls of the tub. Further, the spray nozzles may be placed at the corners of the dish rack so as to create wash zones in the corner of the dish rack.

The dishwasher may include both an upper and lower dish rack. The dish racks may be slidably mounted to the tub along a respective pair of upper and lower rails. The back wall of the tub includes a tub outtake. Preferably, the back wall of the tub includes an upper and lower tub outtake, each of which is in fluid communication with the hydraulic conduit of the dishwasher's spraying system. The tub outtake is configured to engage the hydraulic circuit intake of a respective dish rack in a fluid tight manner so as to direct water into the hydraulic circuit, through the spray nozzle and into the predetermined washing zone.

In operation, a user may slide the dish rack out from the washing chamber of the tub, and place items such as utensils, kitchen ware, or the like, therein. The dish rack is slid back into the tub until the dish rack is fully seated so as to register the hydraulic circuit intake with the tub outtake. The hydraulic circuit intake and tub outtake are docked, and the user closes the door and initiates a washing cycle. Water from the spraying system is introduced into the hydraulic circuit and out the spray nozzles of the dish rack.

With this arrangement, the dishwasher may be configured to introduce water into a plurality of wash zones without decreasing the washing chamber of the tub.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF PREFERRED EMBODIMENTS

Figure 1:
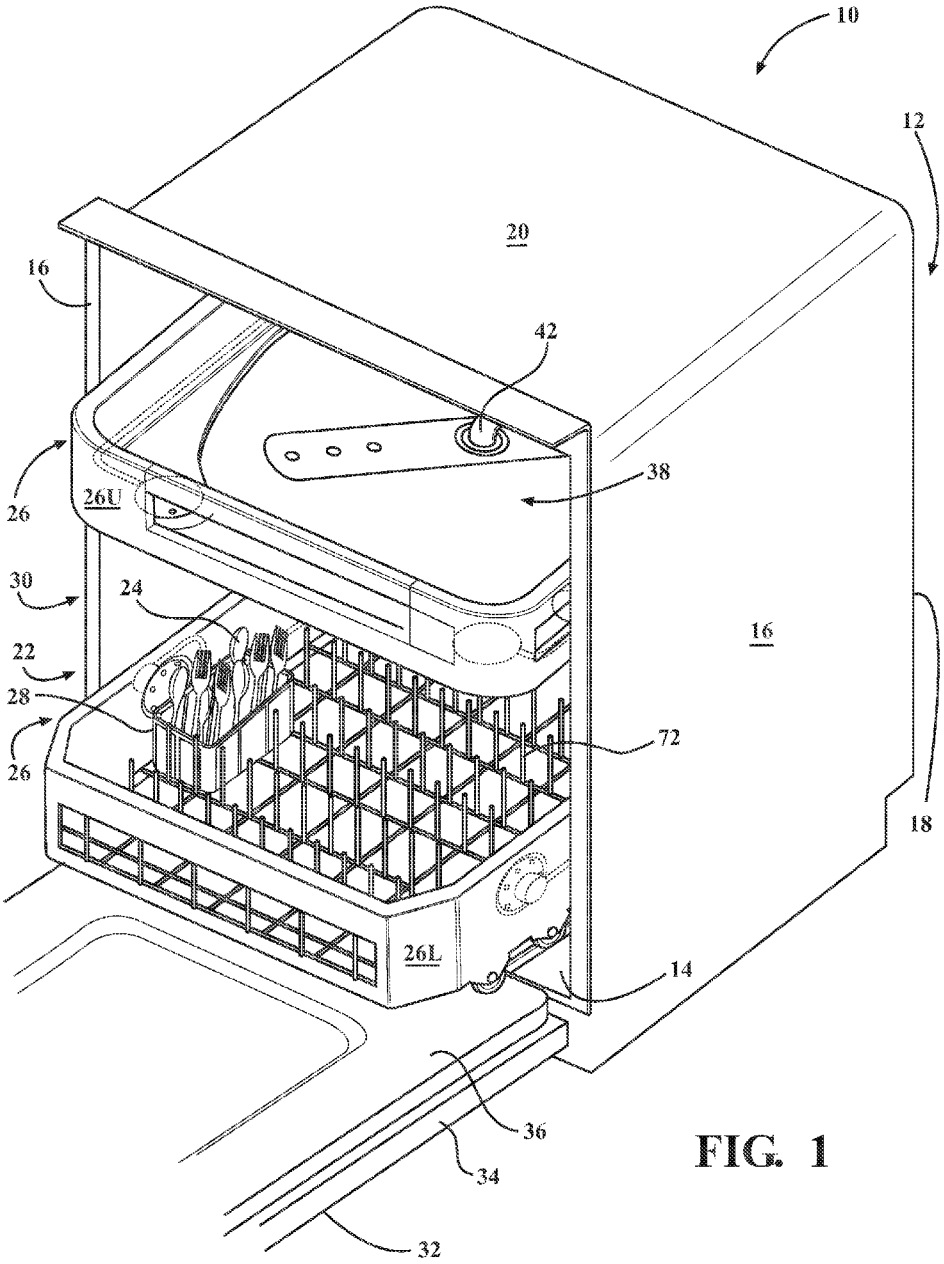
FIG. 1 is a perspective view of a dishwasher incorporating a dish rack having a hydraulic circuit and spray nozzles.
Figure 6:
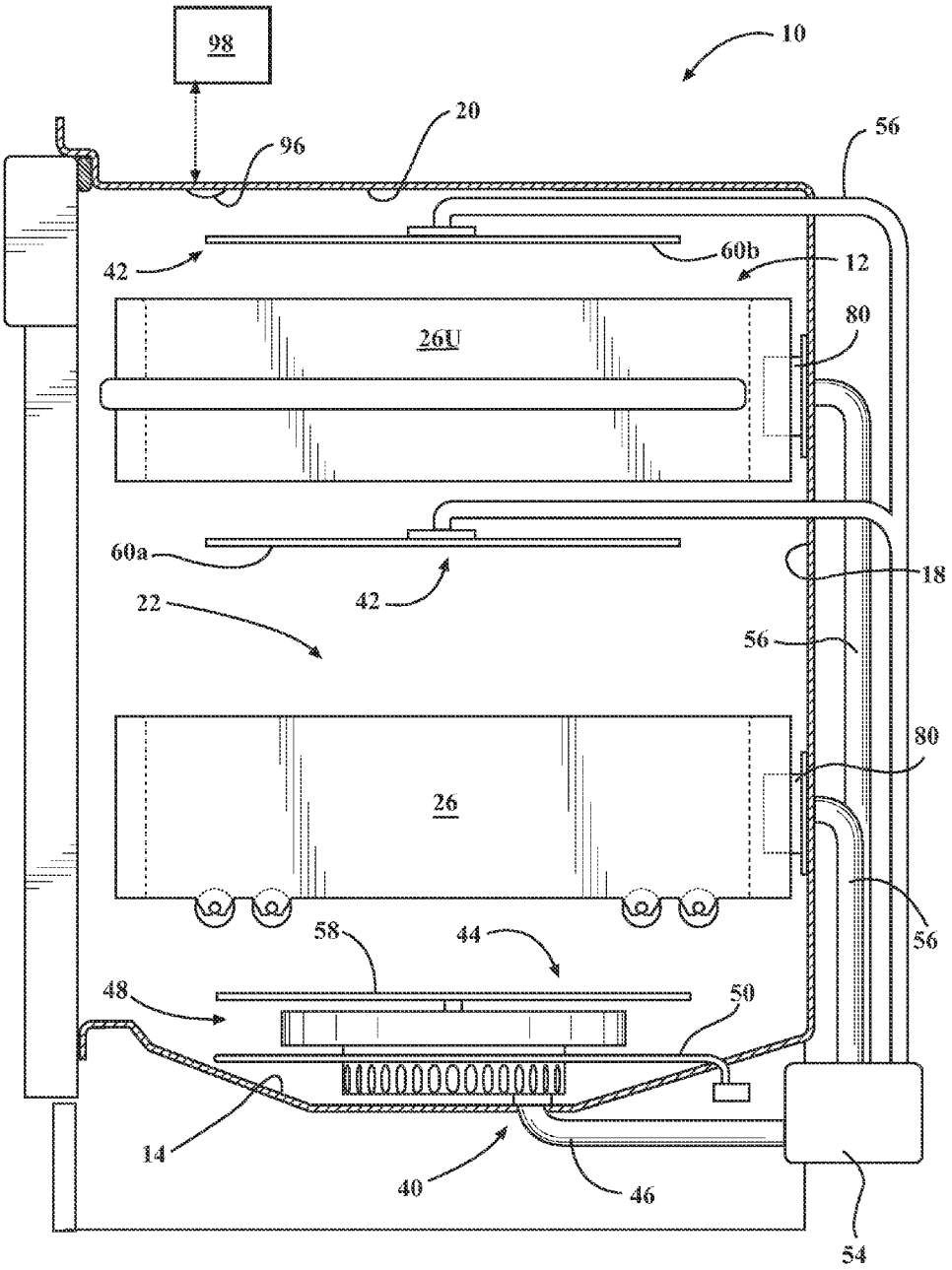
FIG. 6 is a side view showing the upper and lower dish racks docked with respective upper and lower tub outtakes.

With initial reference to FIGS. 1 and 6, a dishwasher 10 constructed in accordance with the present invention is provided. As shown, dishwasher 10 includes a tub 12. The tub 12 includes an integral inner bottom wall 14, a pair of spaced apart and opposite inner side walls 16, an inner back wall 18 and an inner top wall 20. Preferably, the tub 12 is formed of injection molded plastic. Within the confines of the inner bottom, inner sides, inner back and inner top walls 14, 16, 18, 20, the tub 12 defines a washing chamber 22, within which soiled kitchenware or utensils 24 may be placed on a respective lower dish rack 26L and/or upper dish rack 26U. The lower and upper dish racks are generally referenced as 26 in the figures and may also be referenced specifically as 26U or 26L throughout this description.

As shown in FIG. 1, a utensil basket 28, which contains a utensil 24, is positioned within the lower dish rack 26L, alternatively a utensil basket could be placed in the upper rack 26U. Tub 12 has associated therewith a frontal portion 30 at which is pivotally supported a door 32. The door 32 is used to seal washing chamber 22 during a washing operation. The door 32 has an exterior panel 34 and an interior panel 36 preferably provided with a dispensing assembly (not shown) within which a consumer can place liquid or particulate washing detergent for dispensing at predetermined periods of the washing operation.

The dishwasher 10 includes a spraying system 38. The spraying system 38 is configured to spray liquid into the tub 12. The spraying system 38 may include a spray manifold 40, an upper sprayer 42, a lower sprayer 44 and a main outtake 46. The upper and lower sprayer 42, 44 may be a rotatable spray arm or may be fixed.

Disposed within tub 12, is a pump and filter assembly 48. The pump and filter assembly 48 may be mounted within a central opening (not shown) formed in the inner bottom wall 14 of tub 12. Extending about a substantial portion of pump and filter assembly 48, at a position raised above inner bottom wall 14, is a heating element 50. In a manner known in the art, heating element 50 preferably takes the form of a sheathed, electric resistance-type heating element 50. In general, water from a plumbed water source such as a water heater, or a utility source is delivered into the washing chamber 22 through a main intake (not shown). The pump and filter assembly 48 is adapted to direct washing fluid introduced into the tub 12 through the main outtake 46 to the spray manifold 40 and out the upper and lower sprayers 42, 44.

Dishwasher 10 has associated therewith a drain hose (not shown) including at least one corrugated or otherwise curved portion that extends about an arcuate hanger (not shown) provided on an outside surface of dishwasher 10. Drain hose is also preferably secured to tub 12 through various clips in a manner known to those skilled in the art.

The dishwasher 10 may further include a diverter 54, seen at least in FIG. 6. The diverter 54 is operatively connected to the spray manifold 40. The spray manifold 40 may include a plurality of hydraulic conduits 56, each placing the wash water collected in the sump to a respective lower spray arm 58 of the lower sprayer 44, and a first and second upper spray arm 60*a*, 60*b* of the upper sprayer 42. As shown, the second upper spray arm 60*b* is rotatably mounted above the upper dish rack 26U. The second upper spray arm 60*b* is configured to spray water downwardly towards the inner bottom wall 14 of the tub 12. The diverter 54 may be actuated to selectively open and close the hydraulic conduit 56 so as to place a respective lower spray arm 58 and/or upper spray arms 60*a*, 60*b* in fluid communication with the pump and filter assembly 48 in correspondence with the selected wash cycle. Thus, in certain periods of a selected wash cycle, the diverter 54 may be actuated so as to direct wash water to the lower spray arm 58, closing off fluid communication to the upper spray arms 60*a*, 60*b*, or vice-versa. It should be appreciated that the diverter 54 may be configured to provide fluid to both the upper and lower spray arms 60*a*, 60*b*, 58. The diverter 54 may further be configured to provide fluid to the upper and lower dish racks 26U, 26L.

With reference now to FIGS. 2-6 an illustrative embodiment of a dish rack, generally referenced as 26 and specifically as 26U or 26L as the case may be, is provided. The dish rack 26 is configured to deliver water to predetermined wash zones within the tub 12. The dish rack 26 includes a pair of side walls generally referenced as 64, and specifically as 64*a* or 64*b* as the case may be, a front wall 66, a back wall 68, and a base 70. The side, front and back walls 64, 66, 68 of the dish rack 26 may be formed of a molded polymer currently known and used in the art, illustratively including polymers having a high gloss, satin, matte, or metallic finish. The polymer may also be configured to have a color, show a pattern, or have a translucent look. The base 70 may be formed of interconnected wires 72 so as to define a support for kitchen utensils 24 and the like. Some of the wires 72 may extend upwardly to support utensils 24 in a generally upright manner, additionally the wires 72 provide structural strength to the dish rack 26. It should be appreciated that the base 70 may be configured otherwise. For instance, the base 70 may be formed of a continuous planar member extending between respective side wall 64 and the front and back walls 66, 68 so as to form what is commonly referenced in the art as a drawer type dish rack 26. In such as embodiment, the base 70 typically includes an outlet for allowing water to drain.

The outer surface of each of the side walls 64 is adapted to slidingly engage the inner side walls 16 of the tub 12 between a first position and a second position. In the first position, the dish rack 26 is fully disposed within the washing chamber 22 of the tub 12, as shown in the upper and lower dish racks 26 of FIG. 6. In the second position, the dish rack 26 is displaced outwardly from the washing chamber 22 to assist the user with loading the dish rack 26 with utensils 24, as shown in the lower dish rack 26L of FIG. 1 and the upper dish rack 26U of FIG. 4. For instance, the outer surface of the side walls 64 may include a plurality of rollers configured to engage a respective side rail 74 of the tub 12. The side rail 74 extends axially along a horizontal plane of the inner side wall 16 of the tub 12.

The dish rack 26 includes a hydraulic circuit 76, a hydraulic circuit intake 78 and at least one spray nozzle, generally referenced as 82. The hydraulic circuit 76 is disposed between the inner and outer surfaces of the side, front, and back walls 64, 66, 68 of the dish rack 26. The hydraulic circuit 76 has a volume configured to direct wash water though the spray nozzle 82 at a predetermined pressure. It should be appreciated by those skilled in the art that the size of the hydraulic circuit 76 may be modified based upon the size of the pump and filter assembly 48, or the desired wash water pressure exiting from the spray nozzle 82. The hydraulic circuit 76 may extend from the back wall 68 of the dish rack 26, along each of the side walls 64, to the front wall 66. It should be appreciated that the hydraulic circuit 76 may be configured so as to deliver wash water to predetermined areas of the dish rack 26 so as to provide wash water to desired wash zones, or to accommodate design specifications such as water pressure, water volume, and the like. For instance, the hydraulic circuit 76 may include a continuous passage 84 extending between the inner and outer surfaces of the side walls 64, front wall 66 and back wall 68.

Figure 7:
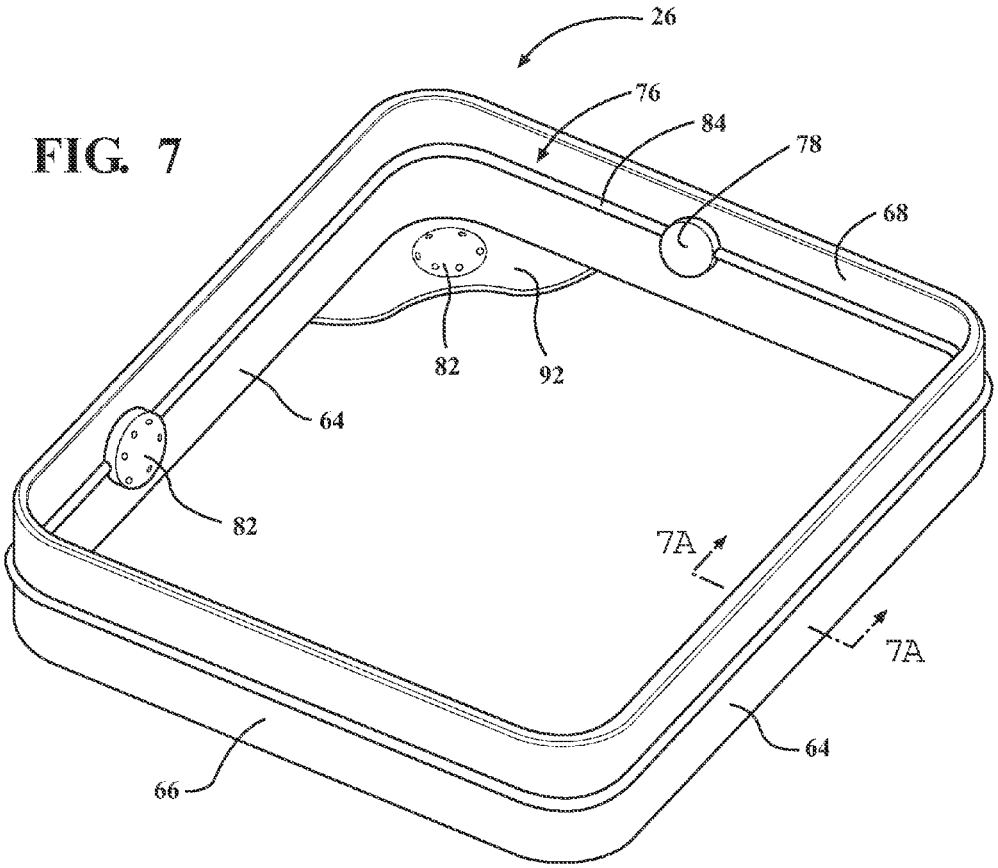
FIG. 7 is a perspective view of a dish rack formed of a single sheet of material.
Figure 7A:
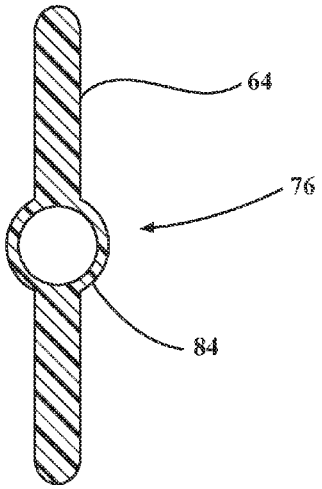
FIG. 7*a* is a cross-sectional view of the dish rack of FIG. 7 taken along lines 7*a*-7*a;*

The dish rack 26 may be formed as a unitary piece, wherein the side, front, and back walls 64, 66, 68 may be formed as single sheet of material made of a molded polymer as shown in FIGS. 7 and 7*a*. With reference first to FIG. 7, the passage 84 of the hydraulic circuit 76 is shown extending beyond the exposed surface of the side, front, and back walls 64, 66, 68. In such instances, the hydraulic circuit intake 78 may be blow molded into the side, front, and back walls 64, 66, 68 during manufacture. With reference now to FIG. 7*a*, a cross section of FIG. 7 taken along lines 7*a*-7*a* is provided. The side wall 64 is shown formed of a unitary sheet of material, and the passage 84 of the hydraulic circuit projects outwardly from the exposed surface of the side wall as a result of a manufacturing process currently known and used in the art, illustratively including a blow molding process.

Figure 8:
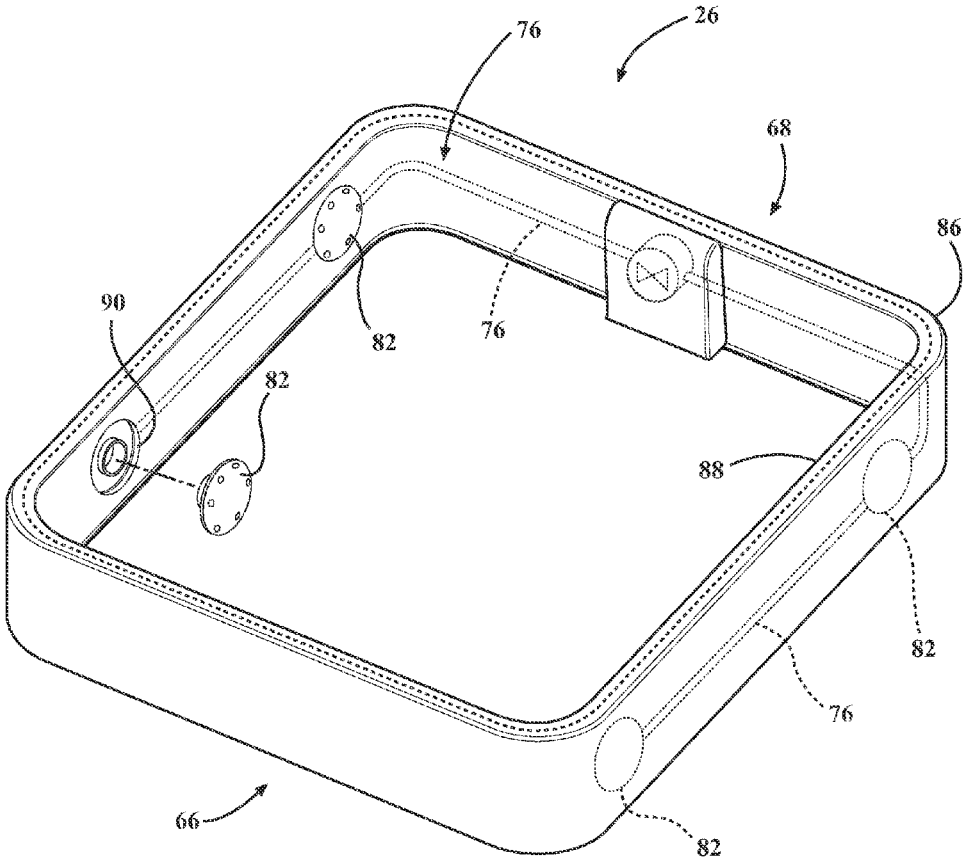
FIG. 8 is a perspective view of a dish rack formed from an inner wall panel and an outer wall panel.

Alternatively, the dish rack 26 may be formed from an outer wall panel 86 spaced apart from and opposite an inner wall panel 88, wherein the hydraulic circuit 76 is formed on one or both inner and outer wall panels 88, 86 as shown in FIG. 8. In instances where the hydraulic circuit 76 is formed on both the inner wall panel 88 and outer wall panel 86 of the dish rack 26, the hydraulic circuit 76 is generally bisected along the length of a respective passage 84, wherein each side is formed on an inner and outer wall panel 88, 86 in a symmetrical manner. Accordingly, attachment of the inner and outer wall panels 88, 86 indicated by the dashed line, forms a unitary hydraulic circuit 76.

Figure 9A:
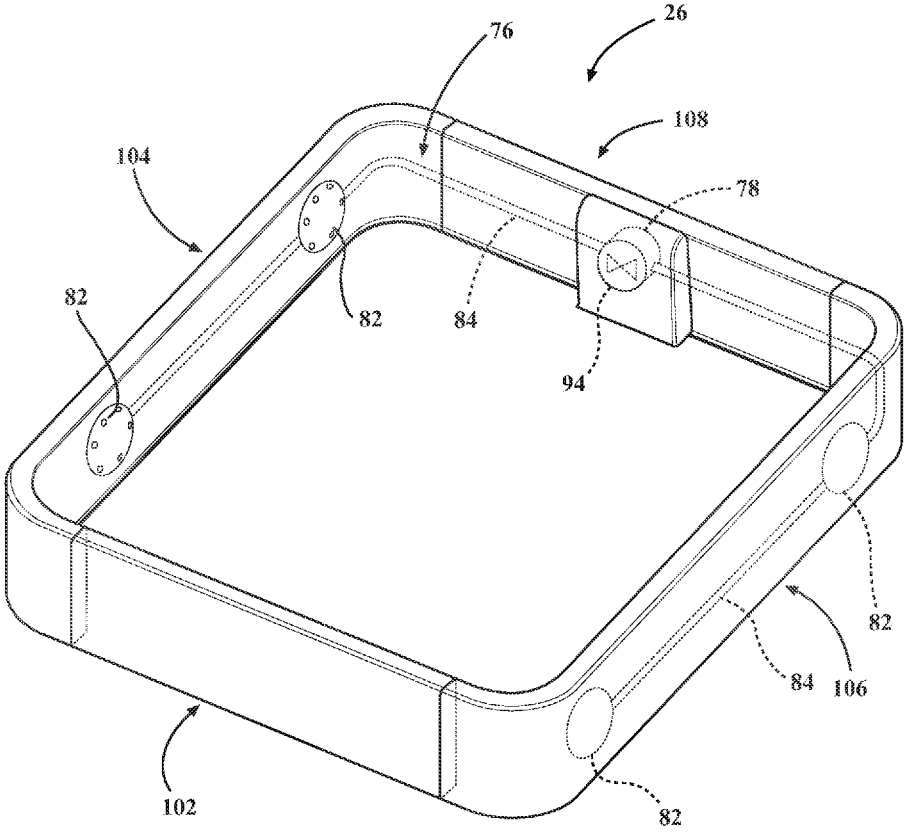
FIG. 9A is a perspective view of a dish rack formed from a front section, two side sections and a back section.
Figure 9B:
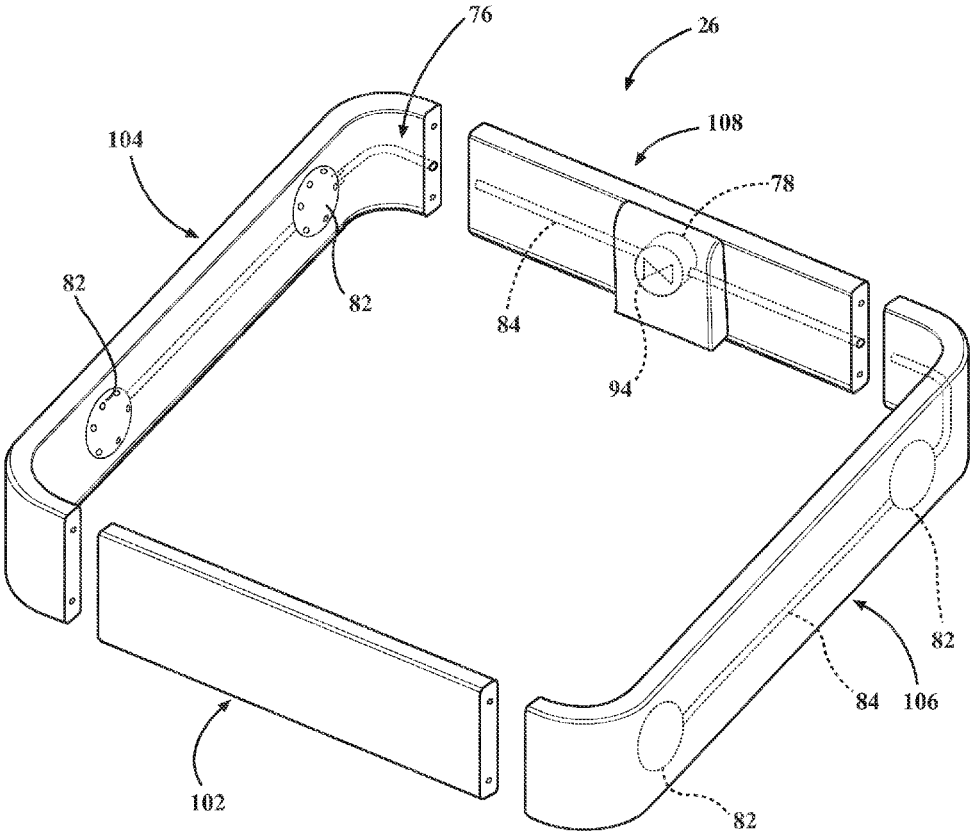
FIG. 9B is an exploded perspective view of a dish rack formed from a front section, two side sections and a back section.

With reference now to FIGS. 9*a* and 9*b*, an illustrative embodiment of the dish rack formed of multiple sections is provided. The dish rack 26 is formed in sections, such as a front section 102, a first side section 104, a second side section 106, and a back section 108. The sections 102, 104, 106, 108 may be formed of a polymer and made using known molding processes. Each section 102, 104, 106, 108 include portions configured to engage one another, and when assembled together as a unit, complete the hydraulic circuit. The sections 102, 104, 106, 108 may be formed with spray nozzles 82 so as to distribute wash water to a desired wash zone. The hydraulic circuit intake 78 may be formed on the back section 108 of the dish rack or a back portion of either one of the first or second side section 104, 106. For instance, ends of each of the front section 102, first side section 104, the second side section 106, and the back section 108 may be configured to engage each other in a snap fit manner so as form the dish rack. Each of the respective front section 102, first side section 104, the second side section 106, and the back section 108 includes a portion of the hydraulic circuit 76 disposed within the walls. Accordingly, assembly of the respective front section 102, first side section 104, the second side section 106, and the back section 108 forms a continuous hydraulic circuit 76.

A portion of the walls 64, 66, 68 of the dish rack 26 may be adapted to provide a support surface 90 for mounting a spray nozzle 82 as shown in FIG. 8, so as to place the spray nozzle 82 in fluid communication with the hydraulic circuit intake 78. Any spray nozzle 82 currently known and used in the art may be adapted for use herein, illustratively including a rotatable or fixed nozzle. Alternatively, the spray nozzle 82 may be integrally molded to the dish rack 26.

The spray nozzle 82 is mounted to the hydraulic circuit 76. The spray nozzle 82 is disposed on the dish rack 26 so as to spray water into a desired wash zone within the washing chamber 22. It should be appreciated by those skilled in the art that the location of the spray nozzles 82 shown in the Figures are provided for illustrative purposes only, and are not limiting to the scope of the invention. The hydraulic circuit 76 is placed in fluid communication with a tub outtake 80 so as to deliver washing fluids to the spray nozzle 82. The tub outtake 80 may be disposed on the inner back wall 18 of the tub 12. Preferably, the dish rack 26 includes a plurality of spray nozzles 82 disposed on the walls 64, 66, 68 of the dish rack 26. The spray nozzles 82 are disposed on the inner surface of the wall of the dish rack 26 so as to distribute wash water to a specific wash zone of the washing chamber 22. For instance, a spray nozzle 82 may be disposed on an inner surface of one of the side walls 64 so as to introduce water into a wash zone occupied by a utensil basket 28.

Figure 2:
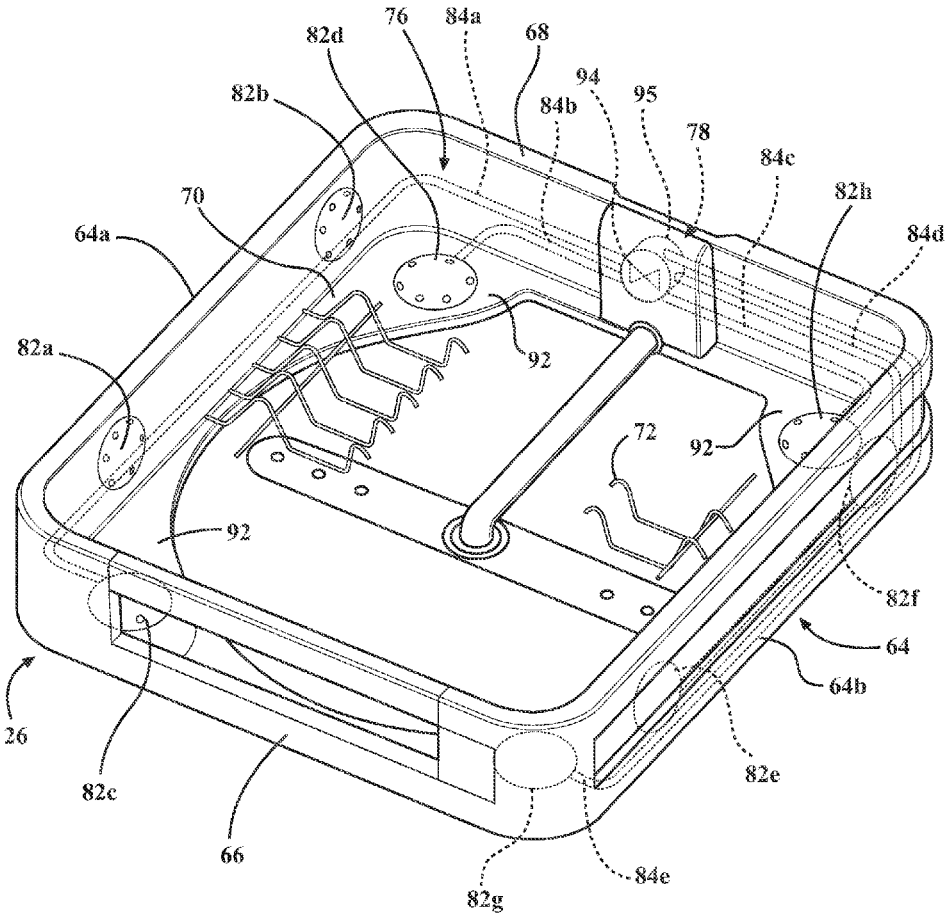
FIG. 2 is a perspective view of the upper dish rack from the dishwasher of FIG. 1.

The dish rack 26 may further include a nozzle base 92 configured to provide wash water to the corners of the tub 12. With reference now to FIG. 2, an illustrative example of a nozzle base 92 is provided. Though the nozzle base 92 is shown disposed on the upper dish rack 26U, it should be appreciated that nozzle base 92 may also be disposed on the lower dish rack 26L. The nozzle base 92 may be disposed on one of the bottom corners of the dish rack 26. It should be appreciated that all four corners of the dish rack 26 may include a nozzle base 92. The nozzle base 92 may be integrally formed to a corner of the dish rack 26 during the injection molding process, or may be formed as a separate unit and attached to a corner of the dish rack 26.

The nozzle base 92 may be particularly useful in instances where the dishwasher 10 utilizes a rotary spray arm so as to help ensure that wash water is delivered to the corners of the tub 12. A spray nozzle 82 is mounted onto a top surface of the nozzle base 92 and is in fluid communication with the spray manifold 40 when the dish rack 26 is placed in the first position. The spray nozzle 82 is operable to introduce wash water upwardly so as to deliver water to a wash zone located at the corners of the washing chamber 22. The spray nozzles 82 may be further configured to spray water in various patterns to better distribute water in a predetermined zone. For instance, the spray nozzle 82 may be operable to spray water in a cone pattern, or in a stream. It should be appreciated by those skilled in the art that the pattern of wash water may be based upon the kitchenware which occupies the intended wash zone.

The dish rack 26 may include a plurality of spray nozzles 82 and nozzle bases 92. With reference again to FIG. 2, an illustration of a dish rack 26 having multiple spray nozzles 82 disposed on the inner surface of the side walls 64 and a nozzle base 92 on all four corners of the dish rack 26 is provided. The hydraulic circuit 76 includes multiple passages, generally referenced as 84, for delivering wash water to the spray nozzles 82. Some of the passages 84 are configured to supply wash water to multiple spray nozzles 82 on a side wall 64. For instance, passage 84*a* is shown in fluid communication with two spray nozzles 82*a*, 82*b*, each disposed on a common side wall 64*a* of the dish rack 26U, and a third spray nozzle 82*c* is disposed on a forward corner of the dish rack 26U. Spray nozzle 82*d* is supplied wash water though passage 84*b*.

Figure 5:
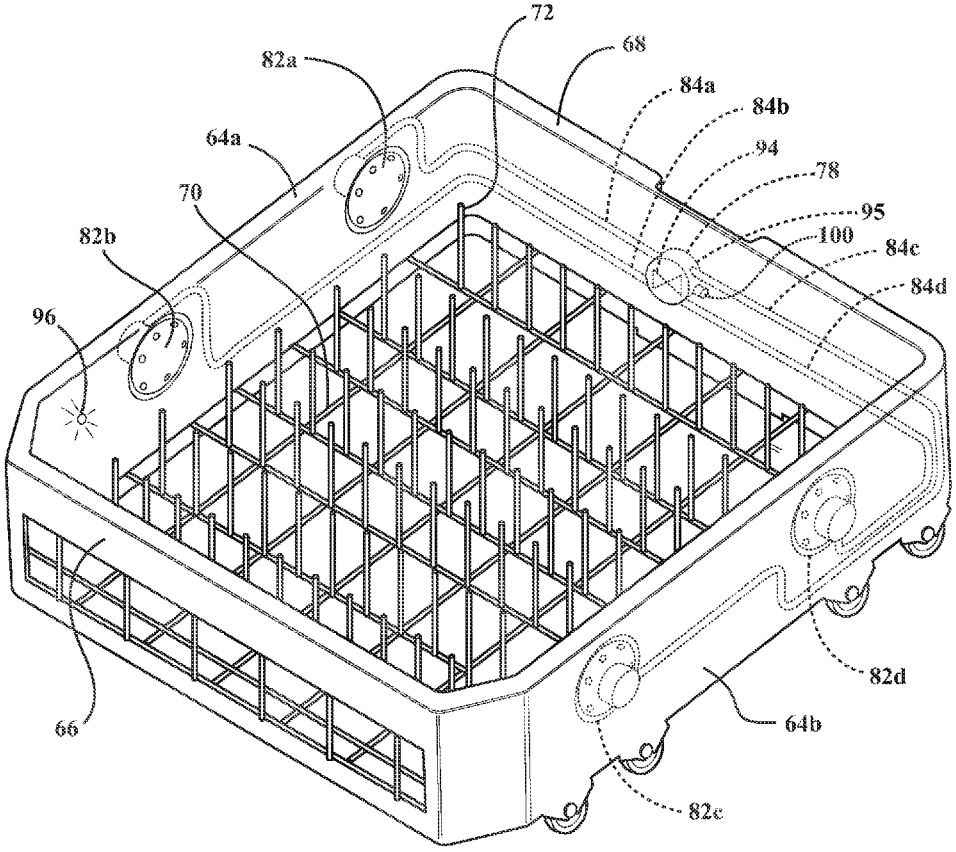
FIG. 5 is a perspective view of the lower dish rack from the dishwasher of FIG. 1.

However, the hydraulic circuit 76 may have a dedicated passage 84 for spray nozzles 82 on the side walls 64 and a separate dedicated passage 84 for spray nozzles 82 mounted to a nozzle base 92 on a corner of the dish rack 26. For instance, FIG. 2 shows side wall 64*b* wherein passage 84*d* is in fluid communication with spray nozzles 82*e*, 82*f* mounted to the inner surface of side wall 64*b*. Spray nozzles 82*g* and 82*h*, both mounted on nozzle bases 92 on respective corners of side wall 64*b* have a dedicated passage, 84*e* and 84*c*. Such a configuration may be desirable for selectively distributing wash water to various wash zones defined by the respective spray nozzles 82. Alternatively, the hydraulic circuit 76 may be configured so as to provide a dedicated passage 84 for each spray nozzle 82, as shown in FIG. 5. Accordingly, it should be appreciated by those skilled in the art that the hydraulic circuit 76 may include a single or multiple passages 84 for delivering wash water into predetermined wash zones, and that the hydraulic circuit 76 is to be configured to assist in the operation of the available washing cycles of dishwasher 10.

Figure 3:
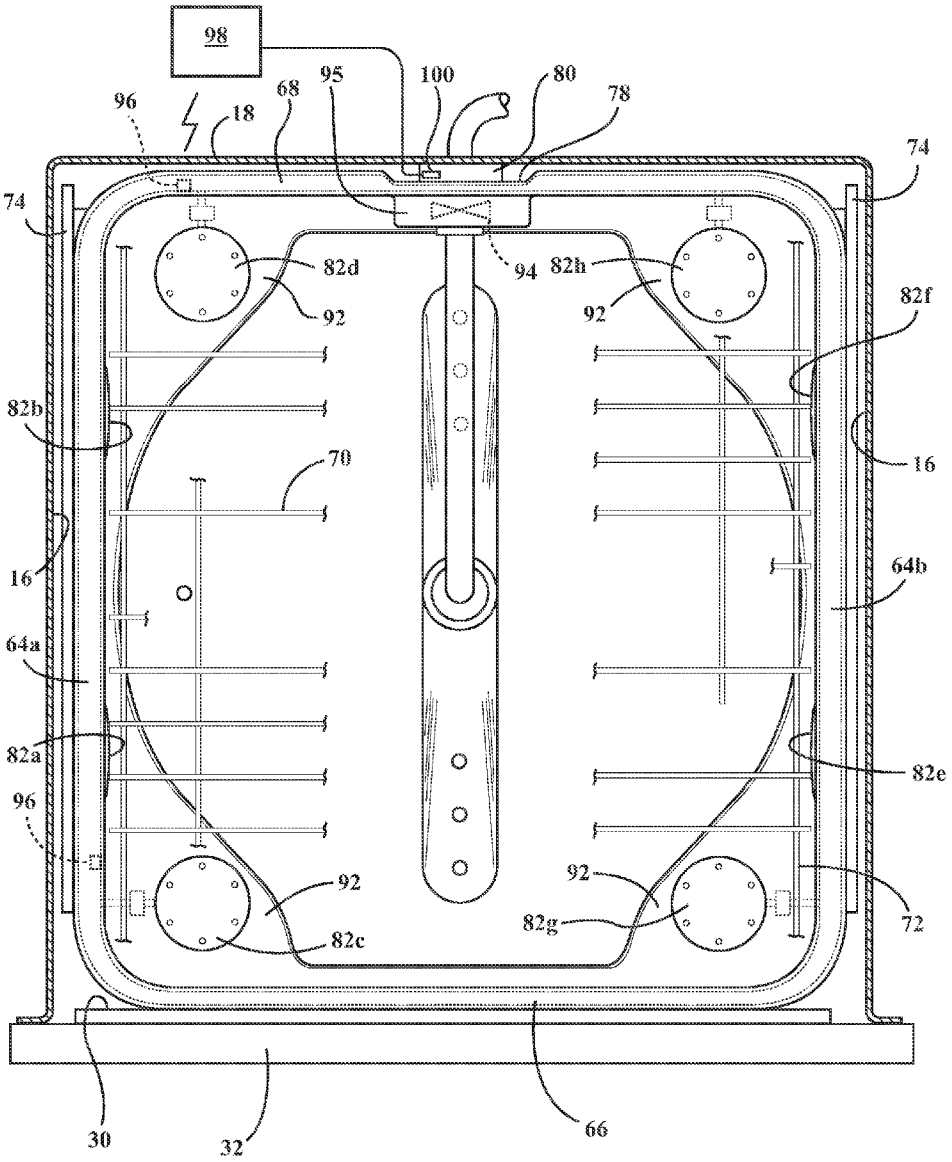
FIG. 3 is a perspective view of the dish rack of FIG. 2, docked with a tub outtake.
Figure 4:
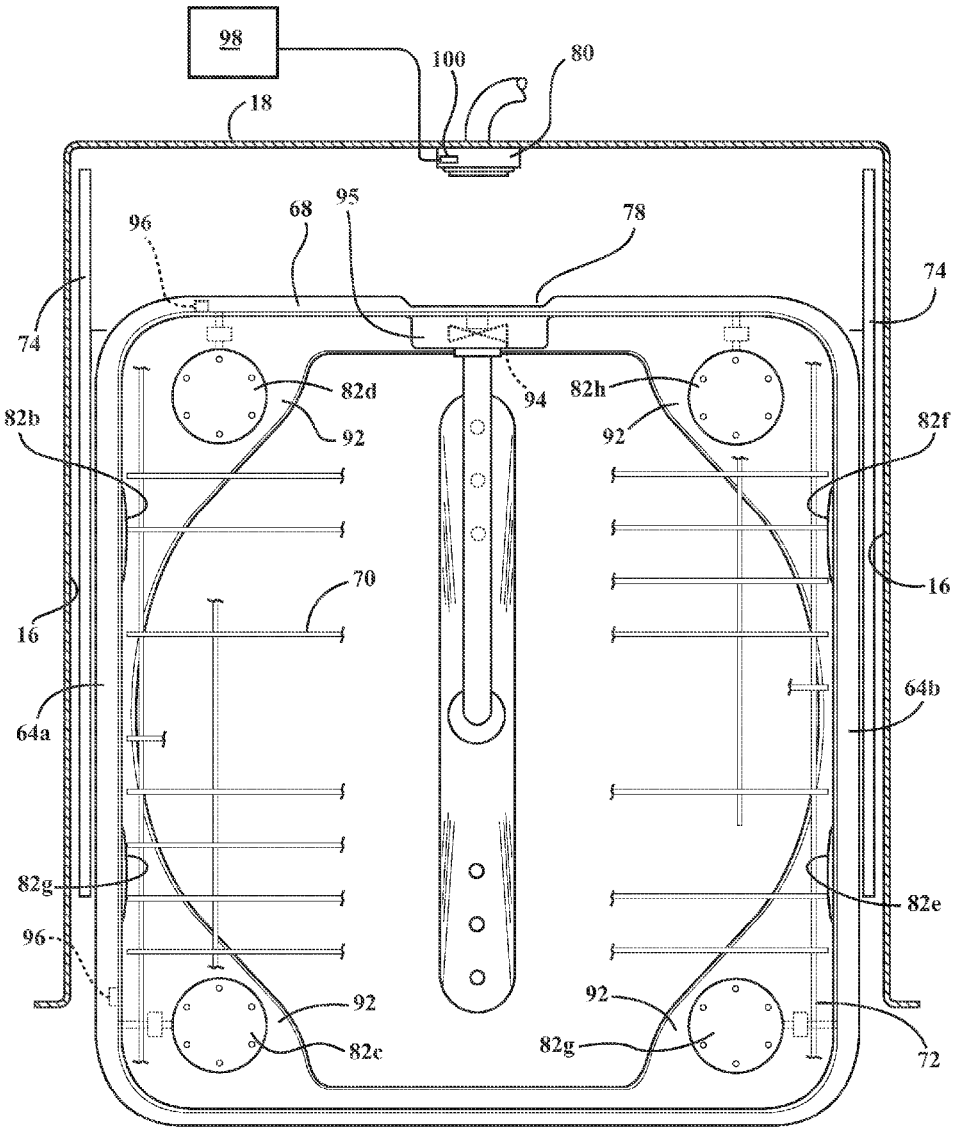
FIG. 4 is a perspective view of the dish rack of FIG. 2, disengaged from a tub outtake.

The hydraulic circuit intake 78 is disposed on an end portion of the hydraulic circuit 76. With reference now to FIGS. 3-6 an illustration of the hydraulic circuit intake 78 is provided. The hydraulic circuit intake 78 is configured to engage the tub outtake 80. Preferably, the hydraulic circuit intake 78 is disposed on an outer surface of the back wall 68 of the upper dish rack 26. The hydraulic circuit intake 78 is configured to seal with the tub outtake 80 so as to create a sealed connection when registered to the tub outtake 80. Further, the hydraulic circuit intake 78 is preferably configured to engage and disengage the tub outtake 80 as shown in FIGS. 3 and 4. The hydraulic circuit intake 78 may be disposed on the back wall 68 of the dish rack 26 so as to engage or dock with the tub outtake 80 when the dish rack 26 is placed in the first position. Further, the hydraulic circuit intake 78 is configured to disengage from the tub outtake 80 when the user pulls the dish rack 26 to the second position to load or unload the dishwasher 10.

The dish rack 26 may further include a valve 94. The valve 94 is operable to open and close fluid communication between the spray nozzle 82 and the passages 84 of the hydraulic circuit 76. The valve 94 is operatively connected to the hydraulic circuit 76 and may be disposed downstream of the spray nozzles 82 and upstream of the hydraulic circuit intake 78 so as to be disposed within the dish rack 26. As shown in FIGS. 2-5, a valve housing 95 is disposed on the back wall 68 of the dish rack 26 and in fluid communication with the hydraulic circuit intake 78. The dish rack 26 may be molded with a valve housing 95 configured to support the valve 94. Any valve 94 currently known and used in the art may be adapted for use herein, illustratively including a mechanical timer which is pressure or flow operated so as to close or open an opening based upon fluid pressure or flow.

With reference again to FIGS. 1 and 6, the dishwasher may include both an upper and lower dish rack 26U, 26L. Each of the dish racks 26 include front, back and side walls 66, 68, 64, a hydraulic circuit 76 and spray nozzles 82 mounted to the inner surface of the side walls 64. The upper and lower dish racks 26U, 26L may be slidably mounted to respective upper and lower rails disposed within the side walls 64 of the tub 12. It should be appreciated that the dish rack may be slidably mounted in other manners currently known and used in the art. For instance, the lower dish rack 26L include wheels adapted to roll along a track disposed on the inner bottom wall 14 of the tub 12. The upper and lower dish racks 26U, 26L are each movable between the first and second positions.

The upper and lower dish racks 26U, 26L include a respective upper and lower hydraulic circuit intake 78. Preferably the upper and lower hydraulic circuit intakes 78 are disposed on respective back walls 66 of the upper and lower dish racks 26. The upper and lower hydraulic circuit intakes 78 are configured to dock with upper and lower tub outtakes 88. The upper and lower tub outtakes 88 are formed on the inner back wall 18 of the tub 12 are registered to receive respective upper and lower dish racks 26U, 26L. Specifically, each of the upper and lower dish racks 26U, 26L is engaged with a respective upper and lower tub outtake 80 when the dish racks 26U, 26L are placed in the second position. Thus, the hydraulic circuits 76 of the respective upper and lower dish racks 26U, 26L are placed in fluid communication with spray manifold 40 through engagement with respective upper and lower tub outtakes 88.

With reference now to FIGS. 2-4, an exemplary illustration of the operation of the upper dish rack 26U is provided. The upper dish rack 26U may be moved between the first and second position. The upper dish rack 26U may be filled with kitchen ware and placed in the first position. For illustrative purposes, the upper dish rack 26 is disposed above the first upper spray arm 60*a*.

The hydraulic circuit 76 includes passages 84 configured to deliver wash water to the spray nozzles 82. FIG. 2 shows one embodiment wherein the hydraulic circuit 76 includes five passages 84*a*, 84*b*, 84*c*, 84*d*, and 84*e*. The spray nozzles 82 are configured to introduce wash water into a wash zone generally disposed in front of the spray nozzles 82. The spray nozzles 82 are shown as fixed nozzles configured to distribute wash water in a cone pattern. It should be appreciated that the spray nozzles 82 shown are fixed for illustrative purposes, and that a rotatable spray nozzle 82 may be used.

The base 70 includes a plurality of wires 72 extending generally transversely between sidewalls 64*a* and 64*b*. Though not shown, it should be appreciated that some of the wires may extending generally upwards. A utensil basket 28 may be placed on the base 70 in front of a respective spray nozzle 82 so as to get direct water treatment from the spray nozzle 82, or the utensil basket 28 may be placed over one of the spray nozzles such as spray nozzle 82*c*. Thus, as the spray nozzle 82 introduces water outwardly from the side wall 64 of the dish rack 26 towards the inner spaces of the tub 12, any utensil 24 or cookware occupying the space in front of the spray nozzle 82 will receive a pressured water treatment.

The dish rack 26U includes a valve 94 which controls the introduction of fluid through the passages 84. Accordingly, the dishwasher 10 may selectively actuate a wash zone in washing chamber 22. For instance, the valve 94 may be operable to selectively introduce wash water to spray nozzles 82*a*, 82*b*, 82*e*, and 82*f* so as to create a wash zone in the space along and in front of the side walls 64*a* and 64*b*. Such a feature may be useful in water and energy conservation as the distribution of water may be controlled. The dishwasher 10 may be programmed to execute a washing cycle wherein only one of the side walls 64 distributes water through the hydraulic circuit 76. In such a program, a first sensor 96, wirelessly or hard wired to a controller 98, may be used to detect the presence of an object in front of the spray nozzles 82, as illustrated in FIG. 3 In instances where the first sensor 96 does not detect an object, water to the respective spray nozzle 82 is shut off.

In operation, a wash cycle is selected and a controller 98 (shown in FIGS. 3, 4 and 6) actuates the diverter 54 to open or close fluid communication between the pump and filter assembly 48 and the tub outtakes 80. In such a manner wash water is selectively distributed through the spraying system 38 and the upper and lower dish racks 26U, 26L. The dishwasher 10 may further include a second sensor 100 operable to detect when the hydraulic circuit intake 78 is fully docked with a respective tub outtake 80. The second sensor 100 provides a signal to the controller 98 in the dishwasher 10 which allows for actuation of the washing cycle when the upper and lower dish rack 26, 26 are properly docked with respective upper and lower tub outtakes 88.

The controller 98 is operatively connected to the valve 94, and may control the configuration of the valve 94 to direct wash water through respective spray nozzles 82. Alternatively, the valve 94 may be what is commonly referenced by those skilled in the art as a mechanical timer operable to open the spray nozzles 82 on the respective side walls 64 at different times. The mechanical timer may be actuated by pressurized fluid, wherein fluid pressure orients the valve 94 so as to open the passage 84 of the hydraulic circuit 76 on one of the side walls 64 while closing the passage 84 of the hydraulic circuit 76 on the other of the side walls 64. This may be desirable when maximum water pressure is desired. For example, the valve 94 may continue to orient itself as water is introduced into the valve housing 95 so as to close fluid communication to side wall 64*a*, while opening fluid communication to the other side wall 64*b* of the upper dish rack 26.

With reference again to FIGS. 1, 5, and 6 the operation of the lower dish rack 26L is provided. As shown in FIG. 1, the lower dish rack 26L is in the second position, wherein the hydraulic circuit intake 78 is disengaged from the tub outtake 80. The user pushes the lower dish rack 26L, wherein the hydraulic circuit intake 78 docks with the tub outtake 80 as shown in FIG. 6. Thus, the spray nozzles 82 are in fluid communication with the tub outtake 80.

The lower dish rack 26 further includes four spray nozzles 82, with two spray nozzles 82 sharing a common side wall 64 and being generally aligned along the same axis extending the length of the respective side walls 64. Further, a spray nozzle 82 on one of the side walls 64 is generally opposite a respective spray nozzle 82 on the other of the side walls 64.

The second sensor 100 is operable to detect if the hydraulic circuit intake 78 is properly docked with the tub outtake 80. The second sensor 100 transmits a signal to the controller 98 indicating that the hydraulic circuit intake 78 is not properly docked with the tub outtake 80. The controller 98 may prevent the dishwasher 10 from operating and issue a warning signal indicating that the lower dish rack 26 is not fully docked. It should be appreciated that the second sensor 100 may be a pressure sensor mounted to a distal end of one of either the hydraulic circuit intake 78 or the tub outtake 80. Thus, the dishwasher 10 may be configured to ensure the hydraulic circuit intake 78 is properly docked with the tub outtake 80 prior to distributing water through the spray nozzles 82 of the lower dish rack 26.

Upon selection of a washing program, water is introduced into the tub 12, and the heating element 50 is operable to heat the circulating water in the tub 12, while the pump and filter assembly 48 is configured to deliver the water into the spray manifold 40, wherein water is introduced into the hydraulic circuit 76 of the upper and lower dish rack 26 through the respective hydraulic circuit intake 78. Wash water entering the hydraulic circuit intake 78 of the lower dish rack 26 may be distributed through the hydraulic circuit 76 in accordance with the operation of a valve 94, as described above. Accordingly, wash water may be introduced to the spray nozzles 82 on the side walls 64 of the lower dish rack 26 at a predetermined interval and either simultaneously to or separately from the spray nozzles 82 disposed on the nozzle base 92.

The diverter 54 is operable to selectively open fluid communication to the spray manifold 40 so as to deliver wash water to the rotary lower spray arm 58 and the lower tub outtake 80. The diverter 54 may place the lower tub outtake 80 and lower spray arm 58 in fluid communication with the pump and filter assembly 48 simultaneously or at different times, depending upon the washing cycle. In instances, where the diverter 54 opens fluid communication between the hydraulic circuit intake 78 of the lower dish rack 26 and the lower tub outtake 80, water may be further controlled through the upper and lower dish rack 26, 26 by use of a valve 94.

For illustrative purposes, the hydraulic circuit 76 includes four passages 84*a*, 84*b*, 84*c* and 84*d*. Each passage 84*a*, 84*b*, 84*c* and 84*d* is dedicated to a respective spray nozzle 82*a*, 82*b*, 82*c*, and 82*d*. The valve 94 may be configured to open or close fluid communication between the tub outtake 80 and the respective passages 84*a*, 84*b*, 84*c* and 84*d* as a function of pressure and time. For instance, the valve 94 may orient itself as it experiences water pressure from the lower tub outtake 80 so as to open fluid communication to the passage 84*a* of side wall 64*a*, and close fluid communication to the other side wall 64*b*. Alternatively, the valve 94 may be configured to open fluid communication to both passage 84*a* and 84*b* on side walls 64*a* simultaneously so as to allow wash water to be ejected from each of the spray nozzles 82*a* and 82*b*, while closing fluid communication to passages 84*c* and 84*d*.

Obviously, many modifications and variations of the present invention are possible in light of the above teachings and may be practiced otherwise than as specifically described while within the scope of the appended claims. For instance, it should be appreciated by those skilled in the art, the hydraulic circuit 76 shown is provided for illustrative purposes and is directed to support the placement of spray nozzles about the dish rack, however such a configuration is not limiting to the configuration of a hydraulic circuit 76 contemplated by the inventors at this time.

What is claimed is:

1. A dish rack for use in a dishwasher, the dishwasher in fluid communication with a water source and having a tub and a spraying system configured to spray water into the tub, the dish rack comprising:

a wall, said wall including at least a back wall and a pair of spaced apart side walls interconnected to the back wall;

a hydraulic circuit extending across and within at least the back wall and configured to be in fluid communication with the spraying system; and a spray nozzle mounted on the wall, the spray nozzle in fluid communication with the hydraulic circuit.

2. The dish rack as set forth in claim 1, further including a hydraulic circuit intake mounted to an outer surface of the wall of the dish rack, the hydraulic circuit intake in fluid communication with the hydraulic circuit.

3. The dish rack as set forth in claim 1, further including a nozzle base in fluid communication with the hydraulic circuit, the wall further including a front wall, with the pair of spaced apart side walls interconnecting the front and back wall so as to form four corners, the nozzle base mounted on at least one of the four corners, the spray nozzle mounted on the nozzle base.

4. The dish rack as set forth in claim 1, wherein the wall is formed from a single sheet of material.

5. The dish rack as set forth in claim 1, wherein the wall is formed by an inner wall panel spaced apart from an outer wall panel, the hydraulic circuit disposed between the inner wall panel and outer wall panel.

6. The dish rack as set forth in claim 1, further including a valve, the hydraulic circuit including a plurality of hydraulic conduits, the valve configured to open and close fluid communication to the hydraulic conduits.

7. The dish rack as set forth in claim 1, wherein the dish rack includes a front section, a first side section, a second side section, and a back section, the front section, first side section, second side section, and back section are configured to engage each other so as form the dish rack, each of the respective front section, first side section, second side section, and back section including a portion of the hydraulic circuit disposed within the walls, wherein assembly of the respective front section, first side section, second side section, and back section forms a continuous hydraulic circuit.

8. The dish rack as set forth in claim 1, wherein the hydraulic circuit is disposed between inner and outer surfaces of at least one of the side walls.

9. The dish rack as set forth in claim 8, wherein the hydraulic circuit is disposed between inner and outer surfaces of the back wall.

10. The dish rack as set forth in claim 9, further comprising a front wall, wherein the hydraulic circuit is also disposed between inner and outer surfaces of the front wall.

11. The dish rack as set forth in claim 1, wherein the spray nozzle has a plurality of outlets arranged in a circular pattern.

12. A dishwasher, having a tub defining a washing compartment and an outtake configured to deliver water into the tub, the dishwasher comprising:

a dish rack having a wall and a bottom bounding a space, wherein at least a portion of the wall is formed by an inner wall panel spaced apart from an outer wall panel and extends up from the bottom;

a hydraulic circuit disposed within the wall, between the inner wall panel and outer wall panel, and configured to be in fluid communication with the outtake; and a spray nozzle mounted on the wall, the spray nozzle in fluid communication with the hydraulic circuit.

13. The dishwasher according to claim 12, wherein the dish rack is movable between a first position, wherein the dish rack is disposed within the washing compartment, and a second position wherein the dish rack is partially displaced from the washing compartment so as to be positioned for loading items.

14. The dishwasher according to claim 13, further comprising a hydraulic circuit intake adapted to mount to the outtake.

15. The dishwasher according to claim 14, wherein the dish rack is an upper and lower dish rack, the outtake is an upper outtake and lower outtake, the dishwasher further including a diverter operable to selectively direct water to the upper and lower outtakes.

16. The dishwasher according to claim 12, wherein the portion of the wall is a side wall of the dish rack.

17. The dishwasher according to claim 16, wherein the dish rack further includes a rear wall, and the hydraulic circuit is also disposed between inner and outer surfaces of the rear wall.

18. The dishwasher according to claim 17, wherein the dish rack further includes a front wall, and the hydraulic circuit is further disposed between inner and outer surfaces of the front wall.

19. The dishwasher according to claim 12, wherein the spray nozzle has a plurality of outlets arranged in a circular pattern.

* * * * *